United States Patent [19]

Anderson

[11] 4,176,296

[45] Nov. 27, 1979

[54] CORE MOUNTING FOR SOLENOIDAL ELECTRIC FIELD LAMPS

[75] Inventor: John M. Anderson, Scotia, N.Y.

[73] Assignee: General Electric Company, Schenectady, N.Y.

[21] Appl. No.: 917,940

[22] Filed: Jun. 22, 1978

[51] Int. Cl.[2] ..... H05B 41/24; H01F 15/02; H01F 27/02

[52] U.S. Cl. ..... 315/71; 315/248; 336/67; 336/92

[58] Field of Search ..... 315/70, 71, 51–54, 315/57, 62, 248; 313/161; 336/65, 67, 92

[56] References Cited

U.S. PATENT DOCUMENTS

| | | | |
|---|---|---|---|
| 2,699,531 | 1/1955 | Massar | 336/92 |
| 4,017,764 | 4/1977 | Anderson | 315/248 |
| 4,070,602 | 1/1978 | Ferro et al. | 315/248 |

*Primary Examiner*—Alfred E. Smith

*Assistant Examiner*—Charles F. Roberts

*Attorney, Agent, or Firm*—Lawrence D. Cutter; Joseph T. Cohen; Marvin Snyder

[57] ABSTRACT

A mounting assembly for a ferrite core disposed within a solenoidal electric field lamp comprises first and second members disposed in chord-like fashion, each having an opening for receiving the core, and in one embodiment, a third member which encircles the core in a chord-like fashion and also encloses the first and second members so as to fixedly hold them to the core when ends of the first and second members are stressedly anchored to points distal from the core. In another embodiment the third member comprises a circular band to which said first and second members are attached, said band being readily affixable to a glass pedestal header assembly. The mounting means cooperate with the lamp assembly so as to reduce the level of electromagnetic interference produced, and can be fabricated rapidly and inexpensively.

17 Claims, 19 Drawing Figures

Fig. 1
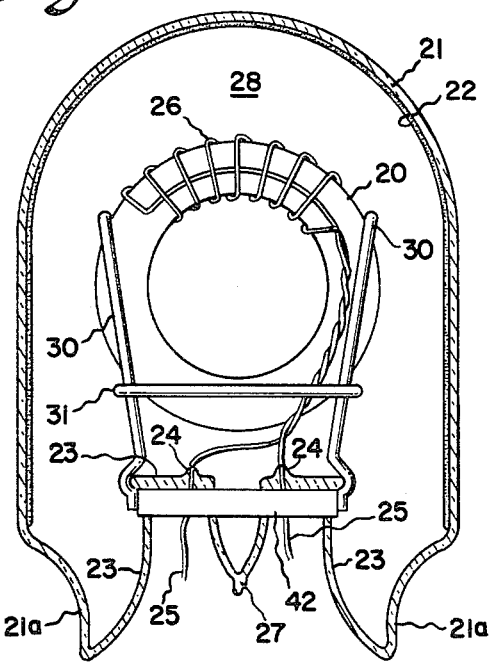
Fig. 2
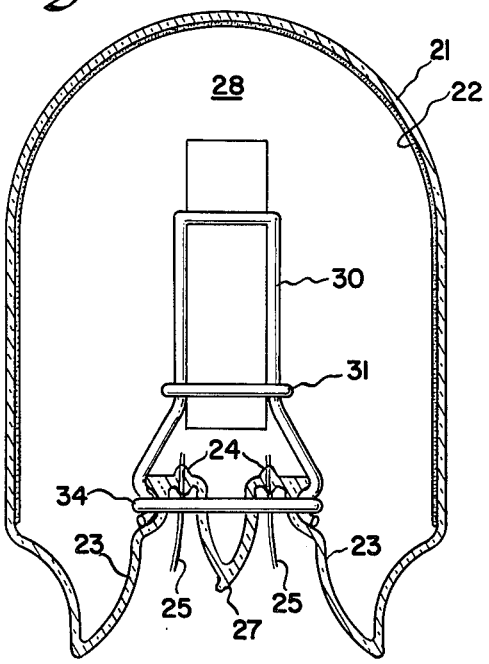
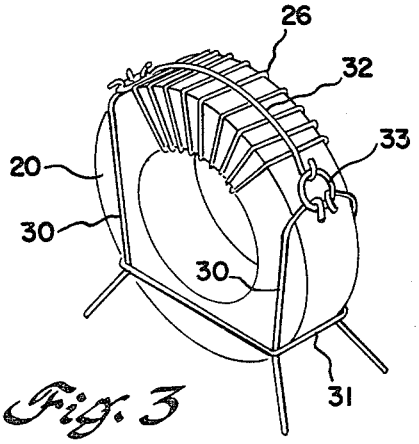
Fig. 3
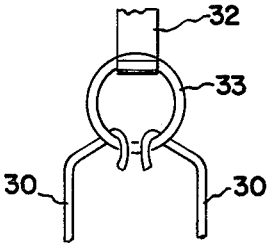
Fig. 4
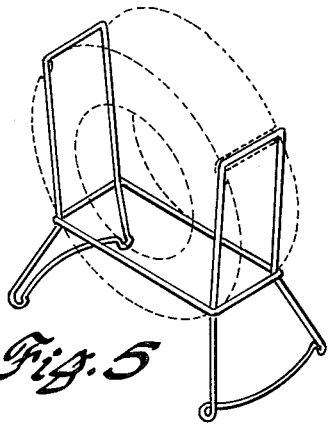
Fig. 5
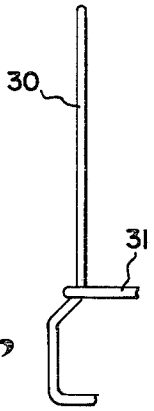
Fig. 6
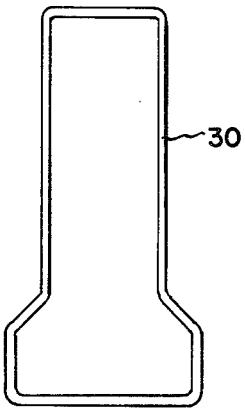
Fig. 7

Fig. 16
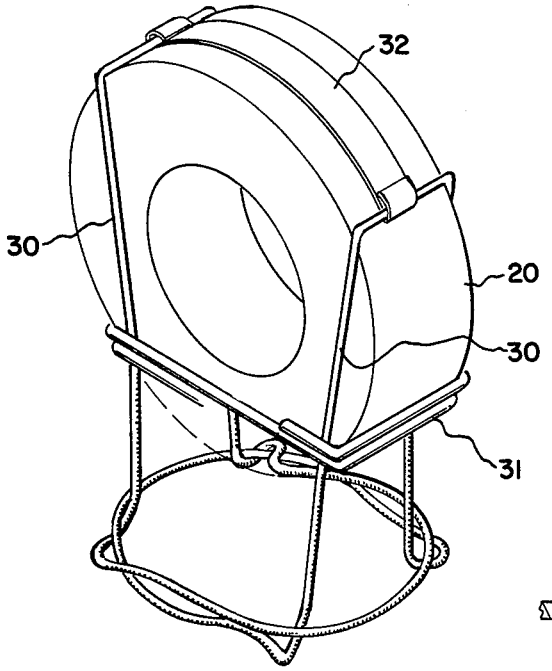
Fig. 17
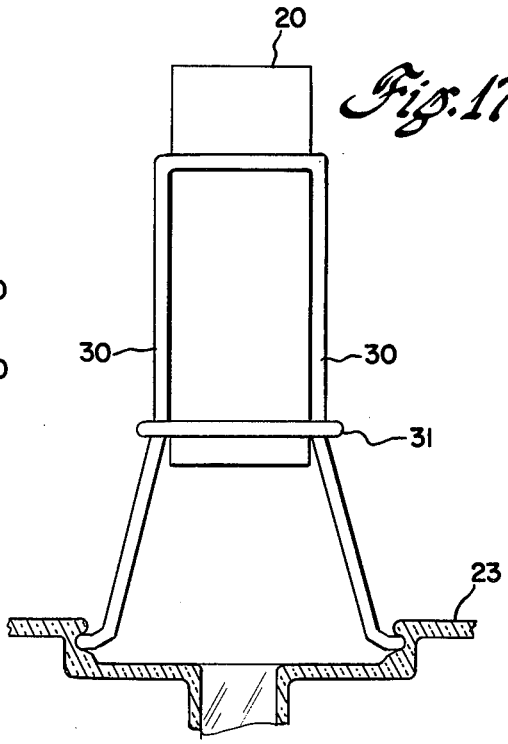
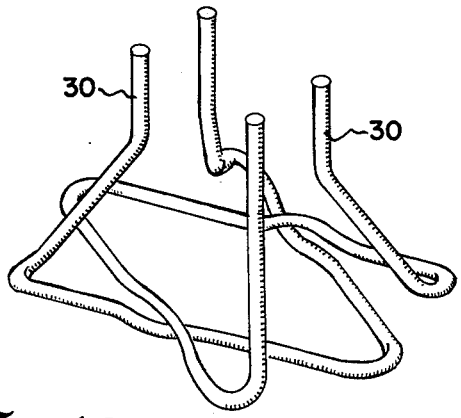
Fig. 18
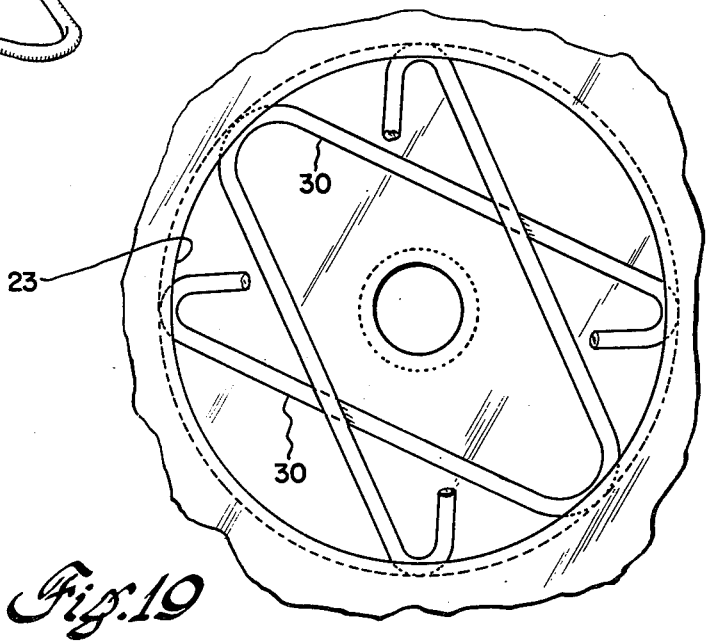
Fig. 19

CORE MOUNTING FOR SOLENOIDAL ELECTRIC FIELD LAMPS

BACKGROUND OF THE INVENTION

This invention relates to solenoidal electric field discharge lamps, and more specifically to means for mounting a relatively massive ferromagnetic or ferrimagnetic toroidal core within the lamp.

Solenoidal electric field lamps typically comprise a transparent evacuable envelope coated internally with a phosphor material. The envelope contains ionizable fill gas such as mercury vapor which emits ultraviolet radiation which excites the phosphor coating to generate visible wavelength radiation. The ultraviolet radiation is produced by the ionization of the fill gas which is ionized by a solenoidal electric radio frequency drive means. The drive means typically comprises a toroidal ferrite core disposed within the fill gas and coupled to a radio frequency energy source by means of windings surrounding the toroid and connected by supporting wires to a radio frequency energy source. Such lamps are described for example, in U.S. Pat. No. 4,017,764, issued Apr. 12, 1977 to John M. Anderson, the applicant herein and also in U.S. Pat. No. 4,070,602, issued Jan. 24, 1978 to Ferro et al., both of which patents are assigned to the same assignee as this application.

When operated at frequencies of approximately 50 to approximately 100 Kilohertz, the preferred core has a thickness of approximately 1.0 centimeters, an outside diameter of approximately 5.4 centimeters and an inside diameter of approximately 3.4 centimeters. A ferrite core possessing these dimensions is a relatively massive object compared with the mass of the other components in the lamp, particularly the glass envelope and the typically solid state ballast and drive circuit which operates to convert electrical energy at line frequency to electrical energy at one or more radio frequencies suitable for ionizing the fill gas. Conventional solenoidal electric field (SEF) lamp structures support the core by means of heavy gauge wires connecting the winding around the core to the energy source or ballast. (See, for example, the above-mentioned Ferro et al. patent.) If such heavy wire is used, the feedthroughs through the glass envelope prevent the use of inexpensive soda lime glass because of differences in thermal expansion coefficients. This expansion problem is solvable only by use of very expensive seals. Additionally, if the assembled lamp is to be protected from mechanical shock during shipping and operation, a more rigid support structure for the ferrite core must be provided which does not interfere with the electrical or optical performance of the lamp. Typically, lamps must be able to withstand drop tests from approximately 6 inches to a hard surface and also from approximately 6 feet to a hard surface when packed for shipment. The consequence of a weak core support may be a broken lamp or a lamp in which the core is displaced so as to have a deleterious effect on the discharge current path through the ionized fill gas. This could produce a drop in lamp efficiency with no readily discernable indication of damage.

SUMMARY OF THE INVENTION

In accordance with a preferred embodiment of the present invention, the core for an SEF lamp is provided with a three or four point mounting assembly which is readily attached to the glass lamp envelope. In addition to providing excellent protection from mechanical shock, the ferrite core may be easily attached to the glass header portion of the envelope, the header being a basal portion of the envelope to which the outer envelope is flame sealed, typically by high speed automated processing equipment. The attachment to the header may comprise spot welding to pins embedded in the header or may simply comprise means for attachment to a recessed channel within a header which comprises a substantially cylindrical pedestal.

In accordance with a preferred embodiment of the present invention, a substantially rectangular, insulated wire loop passes over one side of the core in a chord-like fashion and a second wire loop having substantially the same dimensions passes over the core in a similar fashion. It is to be noted that here and in the appended claims, the term loop means an elongated, substantially continuous, wire-like member forming a closed or partly open structure. A third wire loop also encircles the core in a chord-like fashion and further encircles the first two wire loops. The third loop, however, is positioned relatively perpendicular to the first two loops at the position of closest proximity of the first loop to the second, so as to form the partial cage-like structure holding the core. The first two loops possess ends which are adapted to be anchored at points distant from the core. In this embodiment, increasing tension on the ends of the first two loops tends to more tightly hold the toroid within the loops. Additionally, the toroid may be provided with notches for holding the loops where they traverse from one toroidal face to another across its thickness. An additional wire or strap may be provided joining the first two loops at their most distant points along a circumferential arc of the core. The ends of the first two loops may be anchored to the lamp envelope by spot welding to a wire or strap surrounding a substantially cylindrical header pedestal.

An alternative embodiment of the present invention comprises a mounting apparatus assembled from stamped metal parts. This second embodiment comprises three members, one of which is a circular band adapted to be positioned on a header pedestal. The other members are substantially flat and rectangular with openings adapted to partially receive the toroidal core. One end of each rectangular member is adapted to be attached to the circular metal band member. This end of the rectangular member also advantageously possesses a tab protruding toward the opening at an angle with respect to the flat portion, the tab being adapted to cradle the toroidal core. The other ends of the rectangular members may be adapted to fasten to one another. Such fastening means may include tabs for interlocked connection. The metal band may be fastened about a cylindrical pedestal header or may be spot welded to pins embedded in a substantially flat header.

The mounting assemblies of the present invention not only provide a rigid support structure for the relatively massive ferrite core, but also facilitate rapid automatable assembly of solenoidal electric field lamps which are substantially more efficient and longer lived than conventional incandescent lamps. Additionally, the structure of the present invention is readily adaptable to retain ferrite cores of various sizes. This is useful since the optimal dimensions of the core depend on the frequency chosen to drive the lamp. The mounting structure provided by the invention herein neither interferes with the discharge physics nor with the optical output of the lamp. Even more importantly, however, the metal support structures of the present invention cooperate with the lamp structure to form two shorted turns which are present at a point relative to the core where fringing magnetic fields at the operating frequency emerge from the core. Thus, the metal support structure of the present invention also serves to reduce the amount of electromagnetic interference radiated by the lamp.

Accordingly, it is an object of the present invention to provide a secure mounting means for a toroidal core within an SEF lamp so as to minimize breakage during shipping and operation and to reduce electromagnetic interference from the lamp without impairing the efficiency of the lamp or otherwise interfering with the optical output.

DESCRIPTION OF THE DRAWINGS

FIG. 1 is a partial sectional front elevation view in accordance with a preferred embodiment of the present invention illustrating the relationship between the core, the mounting means, the header and the envelope.

FIG. 2 is a partial sectional side elevation view of the embodiment illustrated in FIG. 1 employing different attachment means.

FIG. 3 is a perspective view illustrating the use of a fourth mounting member disposed along a circumferential arc of the toroidal core.

FIG. 4 is a detailed view of a portion of FIG. 3 illustrating one means for interconnection of certain members.

FIG. 5 is a perspective view illustrating the relationship between the core and the three wire loop members in accordance with one embodiment of the present invention.

FIG. 6 is a front elevation view of two of the support members in FIG. 5.

FIG. 7 is a side elevation view of one of the support members in FIG. 5.

FIG. 16 is a perspective view illustrating an embodiment of the present invention employing circular spring-like retaining means for mounting to the header.

FIG. 17 is a side view illustrating header attachment in an embodiment similar to FIG. 16.

FIG. 18 is a perspective view illustrating attachment means suitable for the header configuration of FIG. 17.

FIG. 19 is a partial top view illustrating the location of the attachment means of FIG. 18 with respect to the header of FIG. 17.

DETAILED DESCRIPTION OF THE INVENTION

Figure 8:
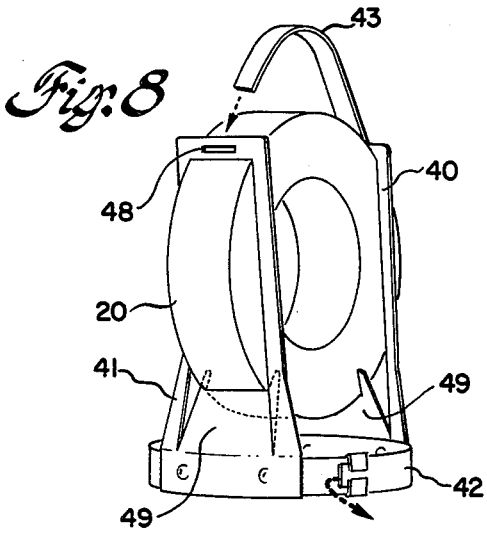
FIG. 8 is a perspective view of another preferred embodiment of the present invention employing flat metal members rather than wire loops.

FIG. 1 illustrates a preferred embodiment of the present invention. The embodiment of FIG. 1 employs wire loops as support members. Thus there is shown toroidal core member 20 preferably comprising a ferrite material exhibiting a low magnetic reluctance. Around core 20 there is disposed a plurality of windings 26 which are connected to a radio frequency energy source through wire leads 25. These wire leads pass through feedthroughs 24 in the glass header 23. Because these wire leads 25 do not have to mechanically support the core 20 the feedthroughs may therefore be relatively small, thus permitting the header 23 to be comprised of relatively inexpensive soda-lime glass. The header 23 is attached to the outer glass envelope 21 at envelope portion 12*a*. The internal surface of the envelope 21 is coated with phosphor 22. Typically this phosphor is chosen to radiate visible wavelength radiation upon excitation by ultraviolet radiation which is produced by a circulating electric discharge occurring within an ionizable fill gas 28 contained within the envelope. The fill gas is preferably a mercury vapor or a combination of mercury vapor and a noble gas such as argon or krypton. In addition to the phosphor coating 22 on the envelope 21, the core header and mounting assemblies may also be coated with a phosphor material to further enhance the amount of visible radiation produced by the lamp.

The toroidal core 20 is fixedly restrained by wire loop members 30 and wire loop member 31. Two wire loops 30 are required. Each loop 30 passes over the core in a chord-like fashion and each is placed on the core in a mirror image fashion with respect to the other. At a point on the wire loops at a chord end proximal to the wire loop ends attached to the header, the third wire loop 31 also surrounds the core and further serves to hold the two members 30 in position. The members 30 and 31 comprise conductive metal material, preferably nickel or steel wire. It is to be noted that the wire loops do not pass through the toroidal openings so as to form a secondary winding. The ends of the wire loops 30 which do not pass over the core 20 itself, are fixedly anchored to points in the lamp distal from the core 20. The greater the tension in the supporting wire loops 30, the more firmly the core is held in position. The ends of the wire loops 30 so anchored are preferably attached to a metal band 42 which is seated within a recess in header 23. Such attachment may, for example, be accomplished by spot welding. The mounting structure thus provided possesses the capability of fixedly yet resiliently holding the ferrite core in place without diminishing the optical output or lamp efficiency. Additionally, each of metal band 42 and second supporting loop 31 provides a closed loop conducting path which path serves to reduce electromagnetic interference radiated by the lamp. Additionally, the mounting structure shown in FIG. 1 is highly ammenable to automatable processing methods. Such methods serve to greatly reduce the cost of the lamp.

Where the ends of wire loop members 30 pass adjacent to the header 23 prior to connection with the metal band 42, there may be provided in header 23 notches which serve to prevent the undesirable and potentially damaging rotation of the core about a vertical axis passing through the header and perpendicular to the axis of the core. Also, notches may be provided in the core 20 where loop members 30 pass over the core from one core face to the other (see FIG. 5). These latter notches assure nonslippage of the wire loops 30 on the core 20.

FIG. 2 is a partial sectional side elevation view of FIG. 1 showing an alternative fastening of wire loop members 30 to the header 23. Here, header 23 possesses a recess, and a wire loop 34 is disposed about the header adjacent the recess so that the ends of wire loops 30 are fixedly held between the header recess and the wire loop 34. Also shown in FIG. 2 is tip-off 27 which is used for out-gassing and back-filling.

The above-mentioned mounting structure and those other embodiments to be described below, are particularly amenable to automatable manufacturing methods. For example, and not by way of limitation, the header 23 with metal wire feedthroughs 24 are manufactured relatively concurrently with the winding of the toroidal ferrite core 20. Wire loops 30 are then disposed about the core 20 and wire loop member 31 is attached, fixedly holding the first two loop members 30 in position. Metal band 34 is disposed in a recess in the header 23 and the ends of wire loop members 30 are spot welded or otherwise attached thereto. Alternatively, a wire loop 34 such as shown in FIG. 2 may be used to fixedly hold the ends of wire loop members 30 to the header 23. The core winding is then attached to the wire feedthroughs 24 and if desired the entire header and core assembly is coated with an appropriate phosphor. The envelope 21 with its internal phosphor coating 22 is is then flame joined to the glass header 23. The tip-off 27, as shown in FIG. 2, is then used for out-gassing and back-filling typically with mercury vapor, before final seal off. The wire leads 25 are then connected to the radio frequency energy source which typically comprises an electronic solid state ballasting circuit serving to convert alternating current at line frequency to radio frequency currents suitable for ionizing the fill gas. Care is taken during assembly to insure that the core 20 is insulated from winding 26. Likewise, supporting members 30 and 31 in this and other embodiments are insulated from winding 36. Many of these steps are similar to present production methods employed in incandescent lamp manufacture which methods are very rapid because of their high degree of automation. Likewise, the methods taught in accordance with the present invention are also highly automatable.

FIG. 3 illustrates another embodiment of the present invention in which there is additionally provided a wire or strap member 32 joining the ends of wire loop members 30 which are furthest removed from the wire loop ends adapted for mounting to the header 23. Like notches in the core 20, the strap or wire 32 prevents slippage of members 30 on the core. Typically, wire or strap member 32 is positioned lastly on the core in a circumferential arc as shown in FIG. 3.

FIG. 4 is a detailed view of a portion of FIG. 3 more particularly describing how member 32 may be attached. Wire or loop member 32 may be looped around and attached directly to wire members 30, or a washer 33 may be provided as shown for interlocking the members into position.

FIG. 5 depicts a slightly different embodiment for wire members 30. Front and side elevation views of these members are shown in FIGS. 6 and 7. Here members 30 are formed from a continuous wire loop and shaped as shown. The material for the loops is selected to retain its resiliency in spite of the relatively high operating temperatures adjacent the core which can exceed 300° C. Such members may be advantageously made from nickel or steel wire. The supporting wire loop members 30 after being affixed to the core 20 along with supporting wire loop member 31, are fixedly attached to the header by any convenient means such as by the wire loop 34 as is shown in FIG. 2. The core 20 itself may be provided with notches as shown for retention of wire loops 30.

One of the important features of the present invention is the ability of the mounting structure to distribute strains due to acceleration and deceleration uniformly throughout the glass header. This is more advantageously accomplished by metal band 42. This stress distribution prevents excessive stress in any single localized region of the glass header.

Figure 15:
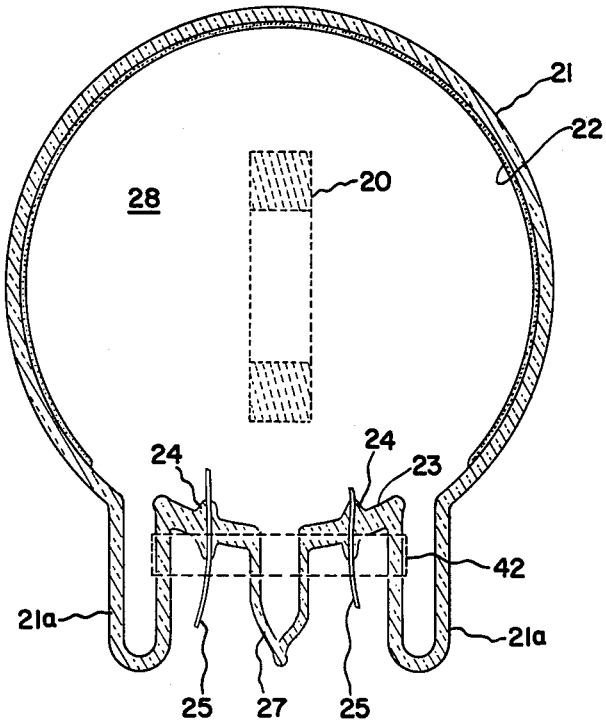
FIG. 15 is a sectional side elevation view illustrating the relationship between the core, a metal support band and a cylindrical pedestal header such as shown in FIG. 1.

An alternative embodiment of the present invention which also uniformly distributes stresses around the header is shown in FIG. 8. Hence, support members 40 and 41 are adapted to partially receive the toroidal core through substantially rectangular openings therein. Members 40 and 41 are disposed with respect to the toroidal core 20 in a fashion similar to that of wire loops 30 in FIG. 1. Members 40 and 41 both advantageously possess a tab 49 which protrudes into the opening adapted to receive the toroidal coil, the tab being angled inward toward the cord so as to further receive and cradle it. The ends of supporting members 40 and 41 nearest the tabs 49 are fastened to a cylindrical band 42 which is adapted to be seated in a circular recessed channel in the header 23 as is shown, for example, in FIG. 15. Again, the ferrite core may be provided with notches for receipt of the tabs 49 or receipt of the other ends of members 40 and 41. Alternatively, member 40, for example, may be provided with a strap or tab extension 43 which is adapted to be inserted in an opening 48 provided in supporting member 41. Such a strap or tab is then folded back to securely connect members 40 and 41 in much the same fashion as wire or strap 32 in FIG. 3. Strap 43 provides additional assurance that the toroid will not be loosened from its mounting during sudden acceleration and deceleration.

The supporting members of the embodiment illustrated in FIG. 8 are preferably nickel or steel. These members are easily produced through conventional metal stamping processes quickly and inexpensively. The assembly comprising metal band 42, with members 40 and 41 attached thereto by spot welding, for example, is preassembled and the ferrite core 20 is simply inserted.

Figure 9:
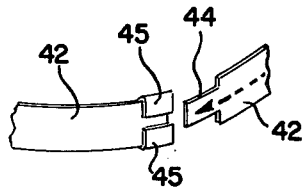
FIG. 9 is a detail of a portion of FIG. 8 illustrating means by which the ends of a metal band portion may be fastened.

FIG. 9 illustrates one means for attachment of the metal band 42 to the header 23. In particular, one end of metal band 42 possesses a tab 44 which is insertable into the opening provided by folding the tabs 45 on the other end of the metal band. The arrow in FIG. 9 illustrates the insertion of tab 44 and the arrow in FIG. 8 illustrates the bending of tab 44 to securely fasten the metal band 42 to the header. While this tab structure is particularly easy to assemble, any conventional means for fastening the ends of the metal band 42 may be employed, including means such as spot welding.

Figure 10:
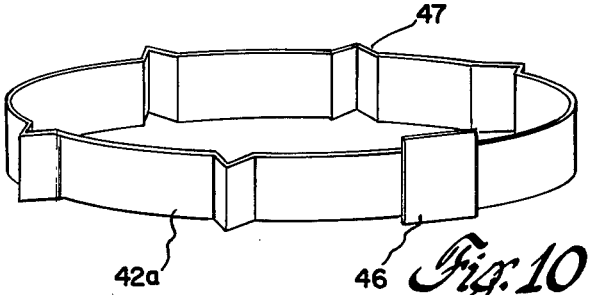
FIG. 10 is a perspective view illustrating one embodiment of the metal band structure shown in FIG. 8.

FIG. 10 illustrates an alternative embodiment of metal band 42. Here, band **42*a* possesses corrugations 47** which act to increase the springiness of the band. Also here the ends of the bands are joined by any convenient fastening means 46. The corrugations 47 also serve to relieve excess strain on the glass header.

Figure 11:
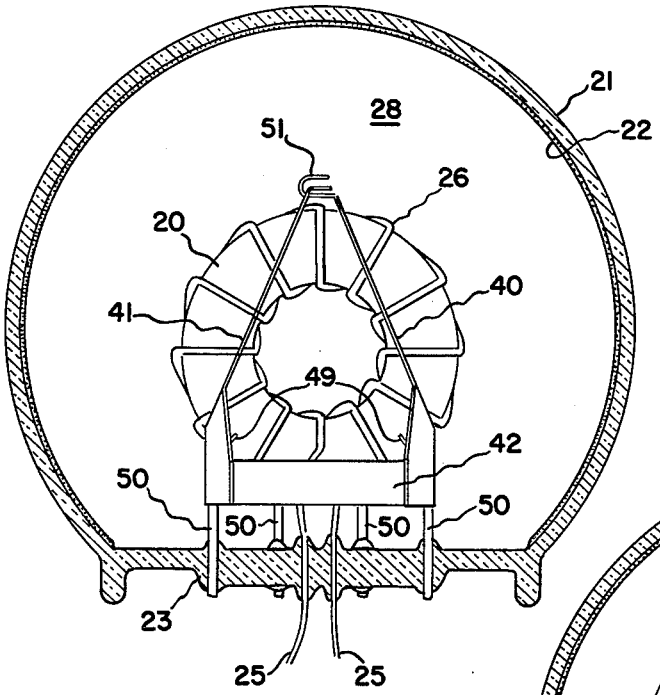
FIG. 11 is a partial sectional side elevation view similar to FIG. 8 except that a circumferential arc member is not employed and a three point mounting assembly results.

FIG. 11 illustrates a slight modification of the core mounting configuration shown in FIG. 8. Here, member 43 (shown in FIG. 8) is not present but members 40 and 41 extend upwards and are interlocked near that portion of the core distal from the header 23. Also shown is a substantially flat header 23 with supporting pins 50 which serve to anchor the metal band 42. With the geometry illustrated, the necessity for a circumferential arc member, such as member 23 in FIG. 8, is eliminated and a three point support system for the core is provided. Again if desired, the core 20 may be notched at the appropriate locations for receipt of tab members 49. Such notches prevent the rotation of the core about its axis. It is to be noted that in assembly, windings 26, which couple the core to the radio frequency energy source, are to be avoided near tabs 49. Such avoidance prevents the possibility of an inadvertent short circuit of the windings through the metal mounting assembly.

Figure 12:
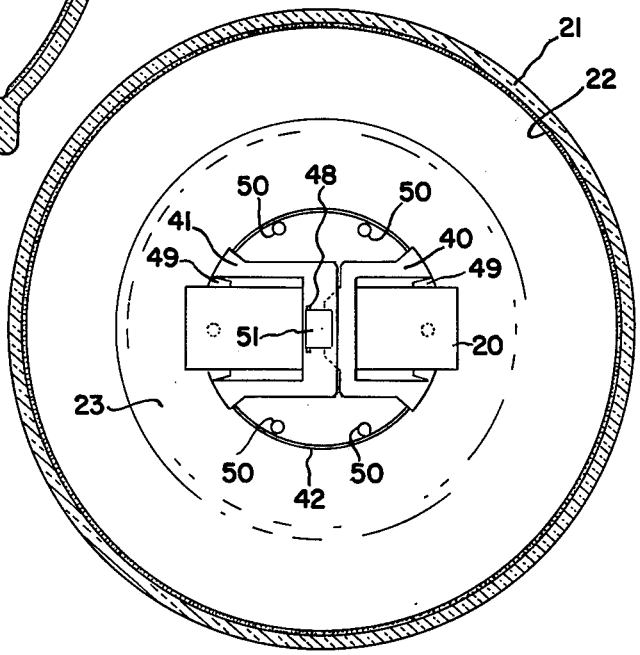
FIG. 12 is a partial sectional top view of FIG. 11.

FIG. 12 is a top view further illustrating the location of the core with respect to the supporting members 40, 41 and 42. In particular, FIG. 12 illustrates the interlocking connection of tab 51 and the opening 48 provided in supporting member 41. These members 40 and 41 are more particularly illustrated in FIGS. 13 and 14 respectively which are front elevation views for each of these members. The bottom ends of these members, nearest tab 49, are adapted to be connected to the metal band 42. This connection may be accomplished, for example, by spot welding. Additionally, member 40 possesses tab 51 at the end opposite tab 49 for interconnection with the upper portion of supporting member 41. Additionally, the interior edges of supporting members 40 and 41, namely those edges immediately adjacent to the core, may advantageously be lipped, beveled or rounded so that insulation is not scraped off of the core 20 or the windings 26 upon insertion into members 40 and 41. This insulation is present in all of the embodiments of the present invention discussed herein. Such insulation is obviously necessary if short circuiting of the windings is to be prevented.

FIG. 16 illustrates an alternative embodiment of the present invention in which the ends of the loops 30 that are proximal to the header, are formed in the shape of two interlocking circular arcs as shown. In this form, the core and mounting assembly may easily be attached to a header 23 such as that shown in FIG. 1, or may equally be attached to a header 23 as shown in FIG. 17. In FIG. 17, header 23 possesses a reentrant recessed region with a lip for restraining the circular arc portions of the loops. The diameter and material of the wire loops are chosen to possess a sufficiently high spring constant so as to tightly hold the core in position.

FIG. 18 illustrates an alternative embodiment of the attachment means shown in FIG. 16. Here, the attachment means are shaped into two substantially triangular portions oppositely aligned as shown. The attachment means of FIG. 18 is shown installed in FIG. 17 in which it is retained in position by means of the lip in the header 23. FIG. 19 illustrates the relation of the attachment means and header. In particular, FIG. 19 illustrates the fact that the attachment means of FIG. 18 are positioned beneath the header lip and are in six-point contact therewith.

Figure 13:
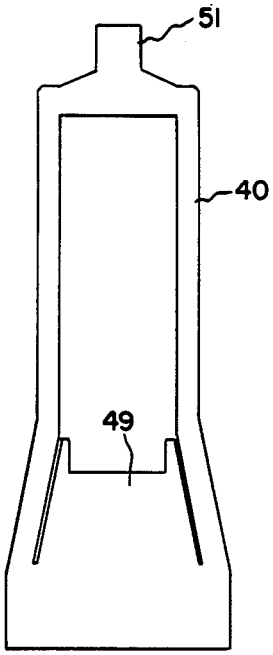
FIG. 13 is a side elevation view of a support member employed in the embodiment shown in FIG. 11.
Figure 14:
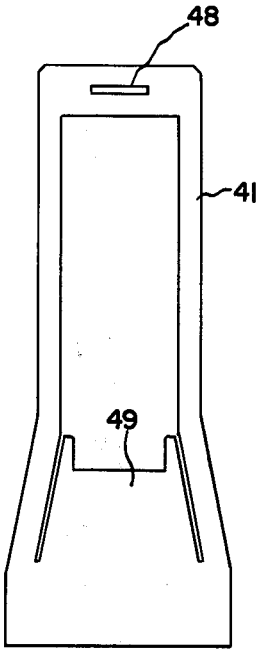
FIG. 14 is a side elevation view of another support member of the embodiment shown in FIG. 11.

As with the other embodiments of the present invention, the embodiments illustrated in FIGS. 8 and 11, for example, provide a closed loop conductive path adjacent to the toroid opening but not interfering therewith. The conductive, closed loop structure is best illustrated in FIGS. 13 and 14. This structure is advantageous for reducing the amount of electromagnetic interference radiated by the lamp during operation. In this way, the mounting structure cooperates with the electrodynamics of the discharge.

From the above, it may be appreciated that the embodiments of the present invention provide a rugged, resilient mounting assembly for a toroidal ferromagnetic core within an SEF lamp. It can be further appreciated that the mounting structure herein is quickly and easily assembled and readily amenable to automatable production methods. The mounting assembly of the present invention also uniformly distributes mechanical motion stresses uniformly so as to minimize the chance of lamp breakage. Thus, while the rotation of the core about several axes is prevented, the mounting assembly also serves to reduce the electromagnetic interference radiated.

While this invention has been described with reference to particular embodiments and examples, other modifications and variations will occur to those skilled in the art in view of the above teachings. Accordingly, it should be understood that the appended claims are intended to cover all such modifications and variations as fall within the true spirit of the invention.

The invention claimed is:

1. An apparatus for supporting a toroidal magnetic core within a gas discharge lamp, comprising:
   - a first wire loop passing over both sides of said core in chord-like fashion, said first loop adapted for attachment to anchor points distally spaced from said core;
   - a second wire loop passing over both sides of said core in chord-like fashion, said second loop having substantially the same dimensions as said first loop, said second loop also adapted for attachment to anchor points distally spaced from said core, said second loop being positioned on said core in mirror image fashion with respect to said first loop; and
   - a third wire loop encircling said core and said first and second loops in chord-like fashion, said third loop chord intersecting those chord ends of said first and second loops which are nearest the portion of said loops adapted for attachment.

2. The apparatus of claim 1 in which said loops are situated entirely outside the boundary of the opening of said toroidal core.

3. The apparatus of claim 1 further comprising:
   - a header assembly of width greater than the thickness of said core having said first and second wire loops attached thereto.

4. The apparatus of claim 3 in which said header assembly includes:
   - a substantially cylindrical glass pedestal with a circular recessed portion, and a ring shaped band about said portion to which said first and second wire loops are attached.

5. The apparatus of claim 4 in which said attachment comprises spot welds.

6. The apparatus of claim 1 further comprising an insulated circular arc member disposed along the exterior circumference of said core and affixed to said first and second wire loops respectively so as to connect with those portions of said first and second wire loops most distal from their attached portions.

7. The apparatus of claim 1 in which said loops comprise material selected from the group consisting of nickel and steel.

8. The apparatus of claim 1 in which the portions of said first and second loops adapted for mounting comprise relatively flat loops lying in a plane substantially parallel to the plane containing said third wire, said flat loop portions being adapted for retention beneath a lip.

9. A solenoidal electric field discharge lamp comprising:

a translucent envelope internally coated with a phosphor material which emits electromagnetic radiation at visible wavelengths upon stimulation by electromagnetic radiation, said envelope including a header;

an ionizable fill gas disposed within said envelope;

a radio frequency electric energy source;

a toroidal magnetic core disposed within said envelope and supported on the header thereof by the apparatus of claim 1; and an insulated winding with a plurality of turns looping through said core and coupled to said energy source.

10. An apparatus for supporting a toroidal magnetic core within a gas discharge lamp, comprising:

a first, substantially rectangular metal strip supporting member possessing an opening centrally located therein, said opening adapted to receive a first portion of said toroidal core;

a second substantially rectangular metal strip supporting member possessing an opening centrally located therein, said opening being adapted to receive a second, distinct portion of said toroidal core, said second supporting member having substantially the same dimensions as the first supporting member; and a cylindrical band member adapted for attachment to a header of said lamp and having diameter less than the outside diameter of said core, said first and second members being attached thereto at points along their width at diametrically opposed locations along said band.

11. The apparatus of claim 10 in which said first and second supporting members possess tab portions protruding toward said opening, said tab portions being angled toward said core so as to cradle it.

12. The apparatus of claim 10 in which said first and second supporting members comprise material selected from the group consisting of nickel and steel.

13. The apparatus of claim 10 further comprising:

a strap connected to said first and second supporting members at locations which are distal from said band member, said strap disposed along the circumference of the toroidal core.

14. The apparatus of claim 10 in which the ends of said first and second supporting members distal from said band member, are connected.

15. The apparatus of claim 10 in which said first and second members are attached to said band member by spot welds.

16. The apparatus of claim 10 in which said band member is corrugated.

17. A solenoidal electric field discharge lamp comprising:

a translucent envelope internally coated with a phosphor material which emits electromagnetic radiation at visible wavelengths upon stimulation by electromagnetic radiation, said envelope including a header;

an ionizable fill gas disposed within said envelope;

a radio frequency electric energy source;

a toroidal magnetic core disposed within said envelope and supported on said header by the apparatus of claim 10; and an insulated winding with a plurality of turns looping through said core and coupled to said energy source.

* * * * *